United States Patent [19]

Sayles

[11] Patent Number: 5,053,088

[45] Date of Patent: Oct. 1, 1991

[54] HEAT-EXPANDABLE BEADS AS BURNING RATE ACCELERATORS

[75] Inventor: David C. Sayles, Huntsville, Ala.

[73] Assignee: The United States of America as represented by the Secretary of the Army, Washington, D.C.

[21] Appl. No.: 375,892

[22] Filed: May 5, 1982

[51] Int. Cl.[5] ..... C06B 45/00

[52] U.S. Cl. ..... 149/21; 149/38; 149/42; 149/79; 149/92; 149/95; 149/113

[58] Field of Search ..... 149/21, 38, 42, 79, 149/92, 95, 113

[56] References Cited

U.S. PATENT DOCUMENTS

| | | | |
|---|---|---|---|
| 3,671,342 | 6/1972 | Slawinski | 149/21 |
| 3,977,922 | 8/1976 | Inoue et al. | 149/2 |
| 4,008,108 | 2/1977 | Chrisp | 149/2 |
| 4,034,675 | 7/1977 | Sayles | 149/108.8 X |
| 4,132,740 | 1/1979 | Shoults | 149/22 X |
| 4,133,706 | 1/1979 | Shoults | 149/22 X |
| 4,141,766 | 2/1979 | Cameron et al. | 149/2 |
| 4,151,022 | 4/1979 | Donaghue et al. | 149/19.4 |
| 4,304,185 | 12/1981 | Sayles | 149/2 |

*Primary Examiner*—Stephen J. Lechert, Jr.
*Attorney, Agent, or Firm*—Werten F. W. Bellamy; Jack W. Voigt

[57] ABSTRACT

Mechanical enhancement of the burning rate of solid propellants is achieved by the incorporation of limited percentages of heat-expandable beads into the solid propellant matrix. When the flame front reaches an individual bead, the bead which contains an expanding or blowing agent (e.g., pentane, 4,4'-oxybis(benzenesulfonyl hydrazide) (Celogen OT), etc., expands to several times its volume and ruptures. Bead expansion or rupture causes a disruption of the propellant's surface, and the flame can penetrate into the propellant. This penetration results in a major increase in burning rate.

5 Claims, No Drawings

HEAT-EXPANDABLE BEADS AS BURNING RATE ACCELERATORS

DEDICATORY CLAUSE

The invention described herein may be manufactured, used, and licensed by or for the Government for governmental purposes without the payment to me of any royalties thereon.

BACKGROUND OF THE INVENTION

The mechanism of burning rate enhancement of solid propellant compositions are generally classified as chemical or mechanical or a combination of each type.

Chemical enhancement of burning rate relates to either catalysis or chemical process interactions to yield increased burning rate, either or both of which may be influenced by or relate to surface phenomena, such as particle sizes, physical shapes, or mechanical interactions.

Mechanical enhancement of burning rate is, as the name implies a material that because of its shape, its distribution within a propellant matrix, and how it reacts under burning conditions can interact to affect or influence burning rate by heat transfer, by alteration of surface area or conditions, or by other physical interactions which influences the chemical and burning processes.

Various mechanical accelerators have been investigated. Some of these have been, (a) aluminum flakes, (b) aluminum staples, (c) aluminum whiskers, (d) graphite linters, (e) thermally-collapsible (shrinkable) tubings, sheets, rods, and hollow fibers, (f) microballoons, etc. Their use has been unsuccessful, when used in composite propellants, due to anisotropic burning characteristics of the propellant that these impart. The most recent material which has come to the fore as a mechanical accelerator is three-dimensional wire forms. The configuration of the wire forms is that of a paper staple in which one leg is at an angle of 90° to the other leg.

The situation, insofar as composite-modified, double-base propellant is concerned, is different from that of composite propellants because of the method of manufacture of the propellant. This process involves the use of casting powder in combination with casting solvent. When the casting powder is loaded into the motor, it is near-randomly oriented, and when solvated by the casting solvent, this produces a propellant which undergoes isotropic burning.

An object of this invention is to provide a mechanical enhancement of the burning rate of solid propellants.

A further object of this invention is to provide a mechanical enhancement of the burning rate of solid propellants by the incorporation of material in the form of heat-expandable beads for the mechanical enhancement of the burning rate of solid propellants.

Still a further object of this invention is to provide heat-expandable beads which are comprised of an expanding or blowing agent which, after incorporating same into a solid propellant composition, results in bead expansion when the flame front of the burning propellant reaches the bead thereby causing rupturing of the bead to bring about disruption of the propellants' surface to thereby enable the flame to penetrate into the propellant which results in a major increase in the burning rate.

SUMMARY OF THE INVENTION

Mechanical enhancement of the burning rate of solid propellants is achieved as a result of the incorporation into the solid propellant composition limited percentages of heat-expandable beads of discrete particles of thermoplastic styrene or its copolymers which contain about 5–8% of an expanding agent or blowing agent. The expanding or blowing agent is selected from pentane, Celogen OT, 4,4'-oxybis(benzenesulfonyl hydrazide), etc., in spherical form to facilitate uniform dispersion throughout the propellant matrix. When the flame front of the burning propellant reaches the heat-expandable bead, the blowing agent will cause the bead to expand several times its volume and rupture. Bead expansion or rupture will bring about disruption of the propellant's surface, and the flame penetrates into the propellant. This penetration results in a major increase in burning rate due to the many additional burning surface areas generated.

The heat-expandable beads can be employed with a composite propellant composition, as well as with a composite-modified, double-base propellant composition.

DESCRIPTION OF THE PREFERRED EMBODIMENT

Composite-modified, double-base propellants and composite propellants have enhanced burning rate when heat-expandable beads of discrete particles of thermoplastic styrene or its copolymers which contain about 5–8% of an expanding agent or blowing agent, e.g., pentane, Celogen OT, 4,4'-oxybis(benzenesulfonyl hydrazide) etc., are incorporated into the matrix of the propellant. Bead expansion or rupture when exposed to the flame front of burning propellant brings about disruption of the propellant's surface, and the flame can penetrate into the propellant. This penetration brings about a major increase in burning rate.

The incorporation of mechanical burning rate augmenters into ultrahigh burning rate solid propellants is presently considered to be essential to achieve the burning rate regimes of current interest for use in advanced interceptors. A combination of mechanical and chemical rate accelerators results in the following beneficial effects over that of chemical accelerators alone:

a. The combination produces a higher burning rate than can be achieved using either accelerator by itself;

b. The combination results in a considerable reduction in the amount of chemical accelerator required to obtain a particular burning rate;

c. Any approach that reduces the amount of chemical accelerator that is needed means a major reduction in the cost of the propellant;

d. The problems associated with migration of the liquid chemical accelerator to the surface of the propellant and into the liner-barrier-insulation is reduced;

e. The loss of chemical accelerator because of its volatility is also reduced.

The carboranyl-catalyzed, hydroxyl-terminated polybutadiene-based propellant, illustrated in Table I, requires about 9% carborane to produce the ultrahigh-burning rates for advanced interceptors (9–10 ips @2000 psi.) whereas, the carboranyl-catalyzed, composite-modified double-base propellant, illustrated in Table II, containing 2.9% aluminum whiskers, only needs 4.7% carboranylmethyl propionate to produce the same burning rate. Since the present price of carborane ranges between $1200–$600 per pound, it is understandable why the composite-modified, double-base propellants were selected for further exploitation. Since there is a larger production capacity for the manufacture of composite propellants, it is desirable to take advantage of this factor. The incorporation of heat-expandable beads can make this a reality.

Table I and II provides a comparison of the composition and characteristics of composite and composite-modified, double-base propellants with and without heat-expandable beads.

TABLE I

COMPOSITION AND CHARACTERISTICS OF A COMPOSITE PROPELLANT WITHOUT AND WITH HEAT-EXPANDABLE BEADS

| | PROPELLANT | |
|---|---|---|
| | A | B |
| COMPOSITION | | |
| Aluminum Powder (Alcoa 5341) | 12.0 | 12.0 |
| Ammonium Perchlorate (70 μm) | 73.0 | 73.0 |
| N-Hexylcarborane | 9.0 | 6.0 |
| Hydroxyl-Terminated Polybutadiene Prepolymer | 6.0 | 6.0 |
| Trimethylolpropane (additive) | 0.06 | 0.06 |
| BA-114* (additive) | 0.3 | 0.3 |
| Isophorone Diisocyanate (additive) | 0.7 | 0.7 |
| Heat-Expandable Beads | 0.0 | 3.0 |
| MECHANICAL PROPERTIES | | |
| Tensile Strength [PSI] | 260 | 350 |
| Strain @ Max. Stress [%] | 17 | 45 |
| Modulus [PSI] | 1700 | 1200 |
| Density [LB/IN$^3$] | 0.062 | 0.062 |
| BALLISTIC PROPERTIES | | |
| Strand Burning Rate [$r_{2000}$] [IPS] | 9.00 | 12.2 |

*Reaction product of 12-hydroxystearic acid and tris[2-methylaziridinyl]phosphine oxide

TABLE II

COMPOSITION AND CHARACTERISTICS OF A COMPOSITE-MODIFIED, DOUBLE-BASE PROPELLANT WITHOUT AND WITH HEAT-EXPANDABLE BEADS

| | PROPELLANT | | |
|---|---|---|---|
| COMPOSITION | A | B | C |
| Casting Powder | | | |
| Nitrocellulose | 16.6 | 16.6 | 16.6 |
| Nitroglycerin | 6.1 | 6.1 | 6.1 |
| Carboranylmethyl Propionate | 4.7 | 4.7 | 3.7 |
| Ammonium Perchlorate (1.0 μm) | 32.8 | 32.8 | 32.8 |
| Aluminum Powder | 7.2 | 7.2 | 7.2 |
| Aluminum Whiskers | 2.9 | 0.0 | 0.0 |
| Heat-Expandable Beads | 0.0 | 2.9 | 3.9 |
| Resorcinol | 0.7 | 0.7 | 0.7 |
| 2-Nitrodiphenylamine | 1.1 | 1.1 | 1.1 |
| Casting Solvent | | | |
| Nitroglycerin | 25.0 | 25.0 | 25.0 |
| Triacetin | 2.5 | 2.5 | 2.5 |
| 2-Nitrodiphenylamine | 0.3 | 0.3 | 0.3 |
| Hexane Diisocyanate | 0.14 | 0.14 | 0.14 |
| Triphenylbismuthine | 0.02 | 0.02 | 0.02 |
| Mechanical Properties | | | |
| Tensile Strength [PSI] | 325–416 | 400–425 | 400–420 |
| Strain @ Max. Stress [%] | 35–54 | 40–50 | 45–55 |
| Modulus [PSI] | 900–1000 | 1000–1120 | 1000–1500 |
| Ballistic Properties | | | |
| Strand Burning Rate [$r_{2000}$] [IPS] | 10.1 | 11.7 | 12.4 |

The data relating to mechanical properties and ballistic properties of the propellants in Tables I and Table II indicate that the incorporation of heat-expandable beads into propellants results in a substantial increase in the burning rates while achieving a substantial savings in the carborane catalyst required to obtain a desired level of burning rate for advanced interceptors. The mechanical properties as a result of changes in the formulations are enhanced or retained at a level attractive for use in advanced interceptors.

The term, expandable bead, is applied to discrete particles of thermoplastic styrene or its copolymers which contain 5–8% by weight of an expanding agent. The capacity to expand to a broad range of densities make expandable polystyrene unique among thermoplastics. Examples of styrene and its copolymers which can be employed with the expanding agent or blowing agent to form discrete thermoplastic particles or beads are: copolymers of styrene and methyl methacrylate, copolymers of styrene and vinyl chloride, and copolymers of styrene and vinyl acetate.

These expandable beads have a bulk density of 38–40 pounds per cubic foot (pcf). They are expandable to a pre-expanded end product density of 1.0–4.5 pcf. The beads can be expanded in a stream or vacuum pre-expander.

The steam pre-expander consists of an upright, cylindrical, insulated tank with a motor-driven vertical shaft to which several horizontal bars have been attached. Stationary horizontal bars are mounted slightly off center across the tank so that they do not interfere with the movement of the moving bars.

The procedure for preparing the expandable beads is as follows: the raw materials, styrene and pentane, are fed into the tank through the side at or near the bottom. Steam is injected into the tank through a separate port. As the beads are expanded, they float to the top of pre-expander, and overflow into the discharge chute. Stirring is necessary during expansion to prevent agglomeration of the beads to occur.

While steam expansion is the most efficient, the product requires aging for 6–12 hours, depending upon density. Minimum density for a single expansion is 0.95 pcf. Lower densities can be achieved by a second expansion at a substantially lower rate.

Vacuum pre-expansion yields a dry, stable product having densities as low as 0.80 pcf. The density of the pre-expanded beads is controlled by preheat time, jacket temperature, degree of vacuum time.

Encapsulation of Celogen OT in a polystyrene matrix is carried out in the equivalent of a Sweetie Barrel in which styrene and Celogen OT are tumbled together. An organic peroxide, such as, t-butyl peroxide is used to catalyze the polymerization of the styrene and bead formation.

I claim:

1. In a propellant composition selected from a composite propellant composition or a composite-modified, double-base propellant composition, said composite propellant composition consisting essentially in weight percents of the ingredients as follows:

| | |
|---|---|
| aluminum powder | 12.0 |
| ammonium perchlorate (70 μm) | 73.0 |
| N-hexylcarborane | 6.0 |
| hydroxyl-terminated polybutadiene prepolymer | 6.0 |
| trimethylolpropane (additive) | 0.06 |
| wetting agent (reaction product of equimolar quantities of 12-hydroxystearic acid and tris[2-methylaziridinyl]phosphine oxide) (additive) | 0.30 |

-continued

| | |
|---|---|
| isophorone diisocyanate (additive) | 0.70; |

said composite-modified, double-base propellant composition consisting essentially of a casting powder portion in weight percents of the ingredients as follows:

| | |
|---|---|
| nitrocellulose | 16.6 |
| nitroglycerin | 6.1 |
| carboranylmethyl propionate | 3.7–4.7 |
| ammonium perchlorate (1.0 μm) | 32.8 |
| aluminum powder | 7.2 |
| aluminum whiskers | 2.9 |
| resorcinol | 0.7 |
| 2-nitrodiphenylamine | 1.1 |

and a casting solvent portion in weight percents of the ingredients as follows:

| | |
|---|---|
| nitroglycerin | 25.0 |
| triacetin | 2.5 |
| 2-nitrodiphenylamine | 0.3 |
| hexane diisocyanate | 0.14 |
| triphenylbismuthine | 0.02 |

the improvement in burning rate achieved by incorporation of from about 2.9 to about 4.0 weight percent of heat-expandable beads of discrete particles of thermoplastic styrene or its copolymers into the propellant matrix of said composite propellant composition, or substituting said heat-expandable beads for said aluminum whiskers when said selected propellant composition is said composite-modified, double-base propellant composition, said heat expandable beads containing about 5–8% by weight of an expanding or blowing agent that results in bead expansion or rupture during propellant burning when the flame front reaches said heat-expandable bead, said bead expansion or rupture bringing about disruption of the propellant's surface to permit flame penetration into the propellant to thereby achieve a major increase in burning rate of said propellant composition.

2. In the propellant composition of claim 1 wherein said improvement in burning rate is achieved by the incorporation of about 3.0 weight percent of said heat-expandable beads containing an expanding or blowing agent, selected from pentane and 4,4'-oxybis(benzenesulfonyl hydrazide), into said composite propellant composition.

3. In the propellant composition of claim 1 wherein said improvement in burning rate is achieved by the incorporation of about 2.9 to about 3.9 weight percent of said heat-expandable beads containing an expanding or blowing agent selected from pentane and 4,4'-oxybis(benzenesulfonyl hydrazide) into said composite-modified, double-base propellant composition.

4. In the propellant composition of claim 3 wherein said carboranylmethyl propionate is present in an amount of about 4.7 weight percent and wherein said improvement in burning rate is achieved by the incorporation of about 2.9 weight percent of said heat-expandable beads.

5. In the propellant composition of claim 3 wherein said carboranylmethyl propionate is present in an amount of about 3.7 weight percent and wherein said improvement in burning rate is achieved by the incorporation of about 3.9 weight percent of said heat-expandable beads.

* * * * *